United States Patent [19]

Leeves

[11] 4,068,593

[45] Jan. 17, 1978

[54] DRIVING OF RAIL CLIPS IN MAKING A RAILWAY RAIL-AND-FASTENING ASSEMBLY

[75] Inventor: Geoffrey Gordon Leeves, Bearsted, England

[73] Assignee: Pandrol Limited, London, England

[21] Appl. No.: 613,026

[22] Filed: Sept. 12, 1975

[30] Foreign Application Priority Data

Sept. 16, 1974 United Kingdom ..... 40273/74

[51] Int. Cl.[2] ..... E01B 29/24

[52] U.S. Cl. ..... 104/1 R; 104/17 A

[58] Field of Search ..... 104/1 R, 2, 17 R, 17 A; 238/1, 321, 349, 378; 227/111, 130; 29/243.5, 243.56, 243.58

[56] References Cited

U.S. PATENT DOCUMENTS

| | | | |
|---|---|---|---|
| 890,108 | 6/1908 | Van Sickel | 227/130 |
| 3,117,531 | 1/1964 | Miller | 104/17 A X |
| 3,330,220 | 7/1967 | Stewart et al. | 104/17 R |
| 3,426,698 | 2/1969 | Foxx et al. | 104/17 R |
| 3,552,320 | 1/1971 | Traupmann | 104/17 R |
| 3,658,246 | 4/1972 | Davies | 238/349 |

FOREIGN PATENT DOCUMENTS

| | | | |
|---|---|---|---|
| 188,455 | 3/1964 | Sweden | 238/378 |

*Primary Examiner*—Robert J. Spar
*Assistant Examiner*—Randolph A. Reese
*Attorney, Agent, or Firm*—Haseltine, Lake & Waters

[57] ABSTRACT

Clips for holding down railway rails are driven into position, for example by driving parallel to the rails, by power-operated apparatus with wheels which run along at least one rail. There may be one or two power-operated devices for driving clips one at a time or two at a time on opposite sides of the same rail or four power-operated devices for driving four clips at a time, one on each side of each rail. The power-operated devices may comprise piston-and-cylinder devices driving levers.

14 Claims, 8 Drawing Figures

Figure 1:
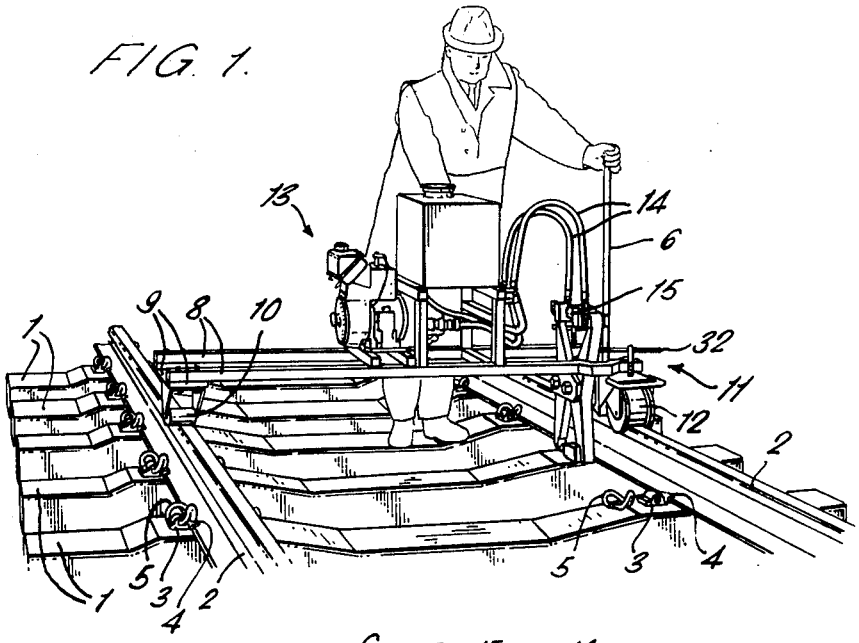

FIG. 2a.
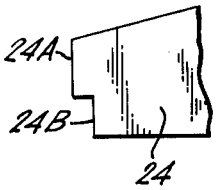
FIG. 5.
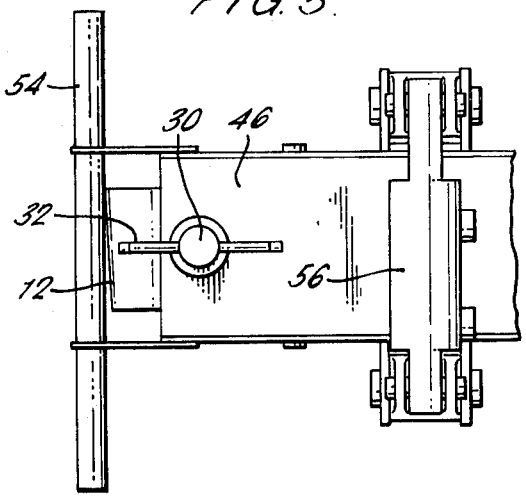
FIG. 6.
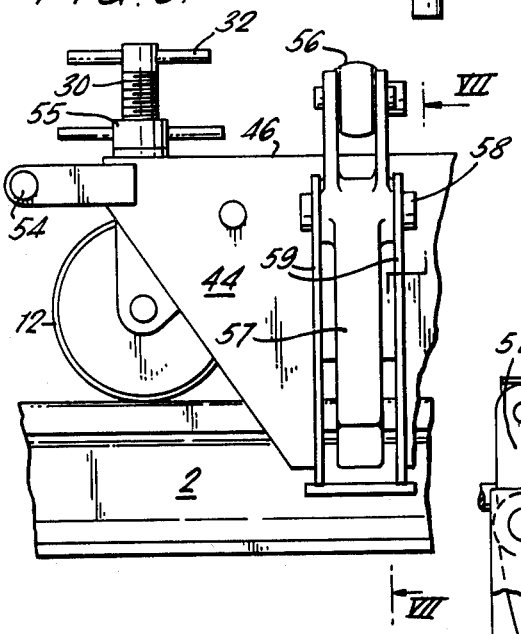
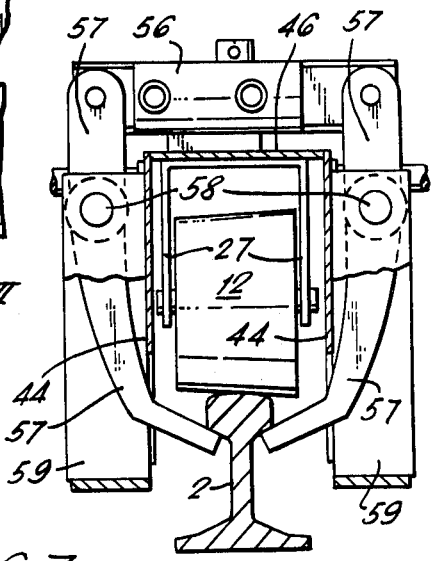
FIG. 7.

DRIVING OF RAIL CLIPS IN MAKING A RAILWAY RAIL-AND-FASTENING ASSEMBLY

According to one aspect of the invention, there is provided apparatus including wheels suitable for running along at least one of two rails of a railway track and for supporting the remainder of the apparatus, a spigot for entering one end of a passage afforded by one of two upward projections on opposite sides of a rail, a portion for engaging a clip a part of which is to be inserted into the other end of said passage and power-operated means for forcing said portion towards the spigot to drive said clip so that said part of it moves along said passage towards the spigot and the clip is driven into a position for holding down the rail.

The power-operated means may be such as to drive the clips substantially parallel to the rails.

Preferably, said portion is positioned to be further from the adjacent rail, when the apparatus is in use, than is said spigot, so that said portion can engage the free end of the clip which is beyond said passage, as seen from the rail.

According to another aspect of the invention, there is provided apparatus for driving rail clips into position to hold down rails of railway tracks, the apparatus comprising two carriages provided with wheels for running on respective ones of the two rails of a railway track, power-operated clip-driving means carried by the carriages and cross-members securing the carriages together, the cross-members including electrically insulating material so as to electrically insulate one carriage from the other.

This apparatus may comprise on each carriage power-operated clip-driving means and it may comprise on each carriage two power-operated means for driving respective ones of two rail clips into positions for holding down opposite sides of the same rail.

According to a third aspect of the invention, there is provided apparatus comprising wheels suitable for running along a rail of a railway track and for supporting the remainder of the apparatus, power-operated means for gripping the rail so that the apparatus can no longer move along the rail and, for association with said rail, two and only two power-operated levers, free ends of which lie beside the rail one on each side thereof in use of the apparatus and can be moved to drive rail clips parallel to the rail.

According to a fourth aspect of the invention, there is provided apparatus comprising wheels suitable for running along both rails of a railway track and for supporting the remainder of the apparatus, power-operated means for gripping one of the rails so that the apparatus can no longer move along the rails and four and only four power-operated levers free ends of which lie beside the rails, one on each side of each rail, in use of the apparatus and can be moved to drive rail clips parallel to the rails.

In all the examples indicated above, the apparatus may have adjusting means for adjusting vertically the positions of at least the parts which engage the clips to drive them. The wheels may be supported in brackets which are abutted by the ends of screws which pass through a support member supporting those parts of the power-operated means which engage parts of the rail and fastening assembly so that said parts of the power-operated means may be raised and lowered by turning the screws.

Parts of the power-operated means which engage the rail and fastening assemblies are preferably supported on a member which is rotatable to a position where said parts cannot engage the rail and fastening assemblies.

The apparatus may in all examples indicated above have power-operated means for gripping the rail.

According to another aspect of the invention, there is provided apparatus for use in making in a railway track a rail-and-fastening assembly including a rail foundation having two upwardly extending projections, a rail laid on the rail foundation between these projections, each of which affords a passage substantially parallel to the rail, and two rail clips each of which comprises a length of resilient metal of rod form which is bent so as to have, progressing from one end of the length of metal to the other, a first portion which constitutes a substantially straight leg, then a second portion in the form of a reverse bend, then a third portion extending generally in the direction of said one end, then a fourth portion which extends from the third portion, generally to that side thereof upon which said leg is disposed, and constitutes a second reverse bend, and finally a fifth portion extending in the general direction towards the junction between the first and second portions, each clip being in a position in which the first portion is in one of the passages, the third portion bears on a flange of the rail and the fifth portion bears on a fixed, unyielding surface which, as seen from the rail, is beyond the first portion, said apparatus comprising a wheeled carriage constructed to run on one of the rails, first and second parts carried by the carriage and movable relatively to it whereby the said parts can be moved from first positions, in which they lie on the same side of said one rail but on opposite sides of said assembly with the first part further from said one rail than is the second part, and movement of the carriage along the rail would make one of the first and second parts strike said assembly according to the direction of movement of the carriage, to second positions in which the carriage can be moved along the rail without either of said parts striking said assembly, a member on the carriage arranged for movement thereof in a predetermined direction to result in said parts coming closer together and means for causing fluid at pressure to cause said member to move in said predetermined direction when said first and second parts are in said first positions so that said first and second parts come closer together and this results in one of said clips being driven into its associated passage by said first part engaging the free end of the fifth portion of the clip.

The power-operated means (if there is only one) or each power-operated means (if more than one) preferably includes a piston-and-cylinder device, pneumatically or hydraulically operated, and preferably includes at least one lever driven by movement of the piston or the cylinder.

According to a further aspect of the invention, there is provided a method of making in a railway track a rail-and-fastening assembly including a rail foundation having two upwardly extending projections, a rail laid on the rail foundation between these projections, each of which affords a passage substantially parallel to the rail, and two rail clips each of which comprises a length of resilient metal of rod form which is bent so as to have, progressing from one end of the length of metal to the other, a first portion which constitutes a substantially straight leg, then a second portion in the form of a reverse bend, then a third portion extending generally in the direction of said one end, then a fourth portion which extends from the third portion, generally to that side thereof upon which said leg is disposed, and constitutes a second reverse bend, and finally a fifth portion extending in the general direction towards the junction between the first and second portions but terminating before reaching an imaginary plane containing the furthest point on the second portion and perpendicular to the axis of said first portion, each clip being in a position in which the first portion is in one of the passages, the third portion bears on a flange of the rail and the fifth portion bears on a fixed, unyielding surface which, as seen from the rail, is beyond the first portion, said method including applying fluid at pressure to a first member (for example the piston or cylinder of a piston-and-cylinder device) which is moved and displaces a second member (for example a lever) which engages the free end of said fifth portion of one of the clips whereby the clip is driven by the second member into said position.

The clips may be substantially in accordance with those illustrated in U.S. Pat. No. 3004716 or U.S. Pat. No. 3658246. Then the power-operated means may be used to pull or push the part of the clip which is referred to in the latter patent as the "fourth portion," to pull or push the part which is referred to as the "second portion" or, and this seems preferable, to push the free end of the "fifth portion."

The rail foundation may be of steel or concrete, for example a concrete sleeper, in which case if it is desired to electrically insulate the rail from the sleeper an insulating pad may be interposed between the top of the rail foundation and the bottom of the rail and insulators placed on the rail flange may insulate the rail from the clips and the upward projections. Thus the assembly may be in accordance with U.S. Pat. No. 3297253.

In all the examples indicated above, the apparatus may also include power-operated means for moving the rail sideways to increase the clearance between rail and upward projection so as to enable an insulator to be inserted between the two and/or power-operated means for lifting the sleeper and/or the rail so that the clips can be driven more easily into position.

Figure 2:
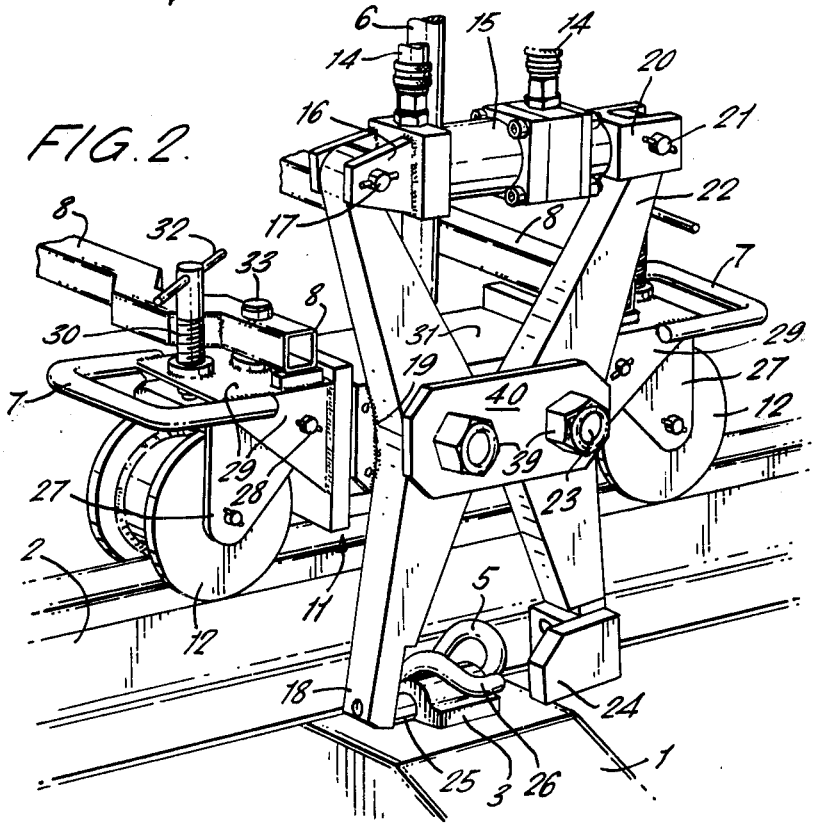
Figure 3:
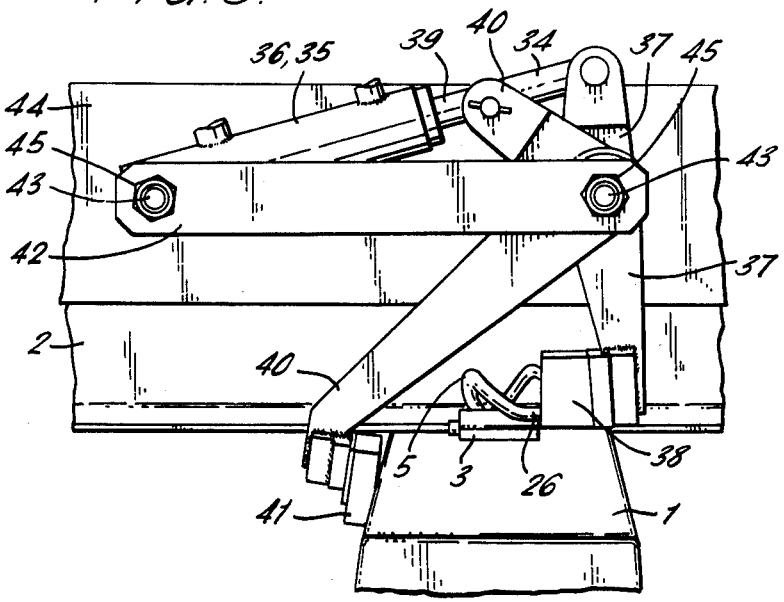
Figure 4:
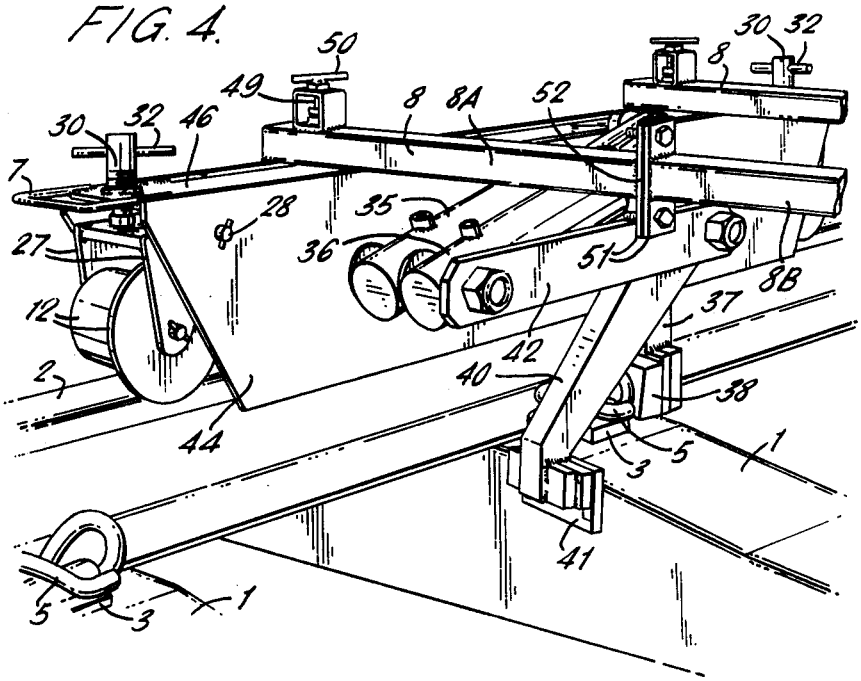

Examples according to the invention are described below with reference to the accompanying drawings, in which:

FIG. 1 shows a front view of a first example of apparatus being used to drive a clip into position for holding down one side of a rail, FIG. 2 shows a side view of a part of the same apparatus being used earlier or later to drive a clip into position for holding down the other side of the same rail, FIG. 2*a* showing a variation of part of this apparatus, in a second example of clip-driving apparatus, FIG. 3 shows a side view of part of a third example of apparatus being used to drive simultaneously two clips into positions for holding down opposite side of a rail, FIG. 4 shows a view from the opposite side of part of the third example being used as aforesaid, FIG. 5 shows a plan view of part of a fourth example of clip-driving apparatus, FIG. 6 shows a side view of what is shown in FIG. 5, and FIG. 7 shows a view, in section taken as indicated by the arrows VII in FIG. 6, of what is shown in FIG. 5.

FIG. 1 shows a number of concrete railway sleepers 1 across which lie two flange-footed rails 2. In each sleeper there are anchored four metal anchoring members 3 which afford four upward projections on the sleeper. One rail is laid on a rubber pad on the sleeper between two of the upward projections and the other rail is laid on a rubber pad on the sleeper between the other two upward projections. Electrical insulators 4 substantially of L-shaped cross-section are placed on the edges of the rail flanges, separating the upward projections from the rail flanges, and rail clips 5 according to U.S. Pat. No. 3658246 are used, one on each side of each rail, to hold the rail down, each of them having what is referred to in U.S. Pat. No. 3658246 as its "first portion" driven into a passage, parallel to the rail, in one of the upward projections, its so-called "third portion" bearing downwardly upon one of the insulators and thus upon the rail flange and its so-called "fifth portion" bearing downwardly upon a seating on the anchoring member 3, this being a fixed unyielding surface which, as seen from the rail, is beyond the "first portion." FIG. 1 shows a number of clips already driven into position, one being driven and one lying on a sleeper beside an anchoring member 3. What has been described so far with reference to the drawings is a number of what are called herein "rail and fastening assemblies."

To drive the "first portion" of each clip 5 into the passage in an anchoring member 3, there are power-operated means carried on a trolley. The trolley includes two cross members 8 which are parallel to the sleepers, the left-hand ends (considering FIG. 1) being fastened together by a connecting piece 9 on which is mounted a wheel in the form of a small roller 10 which runs on the top of one of the rails. At the other ends, the cross members 8 are connected to a carriage 11 having two wheels 12 which run on the top of the other rail. Supported on the bars 8 are means 13 for supplying oil at pressure through flexible tubes 14, these means 13 comprising a gasoline engine, a gear pump driven by the gasoline engine and a tank of oil. The trolley also carries a piston-and-cylinder device 15 to which oil can be supplied on one side of the piston when desired and on the other side when desired through one and then the other of the tubes 14 when a valve (not shown) is operated. The cylinder is connected to a bracket 16 which is pivotally connected at 17 to an arm 18 which is welded at 19 to a member 31 on the carriage 11. The piston is connected to a bracket 20 which is pivotally connected at 21 to an arm 22 which is pivotally connected at 23 to the member 31 and carries at its lower end a detachable shoe 24. The axes of all these pivotal connections are horizontal and parallel. Two screws extending from the member 31 pass through the arms 22 and 18 and a plate 40 and receive nuts 39, the axis of the right-hand screw providing the pivot axis at 23. The lower end of the arm 18 carries a spigot 25 which can be inserted in the flared mouth of the passage in the anchoring member 3, at one end of the passage. The "first portion" of the rail clip has its leading end inserted in the other end of the passage and then this "first portion" is driven into the passage, until it encounters the spigot 25, by supplying oil at pressure to one side of the piston, causing the upper end of the arm 22 to move to the right and the lower end to the left, which causes a surface on the left-hand side of the shoe 24 (which is positioned to be further from the adjacent rail, when the apparatus is in use, than is the spigot) to move past that point on the "second portion" of the clip which is referred to above as the "furthest point," without engaging the "second portion" of the clip, and to abut the free end of the "fifth portion" 26 of the rail clip, which is beyond the passage in the anchoring member 3, as seen from the rail. If desired, the spigot 25 may be omitted and then the shoe 24 may be modified in accordance with FIG. 2*a* by removing a portion of it so that a face 24A of it, further from the rail than is the lower end of the arm 18 engages the free end of the portion 26 of the rail clip and eventually a face 24B of it encounters the near end of the anchoring member 3 to stop the driving of the clip when it is in the desired position so that overdriving is prevented. The arm 18 may abut the anchoring member whether or not the spigot 25 is present.

Each of the wheels 12 is mounted on an axle which is supported at both ends by a bracket 27 which is pivotally connected at 28 to another bracket 29 on the carriage 11. A screw 30 provided with a tommy bar 32 passes through the top of the bracket 29 and bears on the top of the bracket 27 so that by turning the screw 30 by means of the tommy bar the bracket 27 may be made to turn about the pivot axis at 28 with respect to the bracket 29 and thus the arms 18 and 22 may be raised and lowered. Thus the apparatus can be used with rails of different height.

The arms 18 and 22 are carried by the member 31 which is pivotally mounted on and between the brackets 29, the pivot axis being parallel to the rail, so that the member 31 and the arms can be swung about this horizontal axis when the trolley is to be moved from one sleeper to the next and thus the arms 18 and 22 do not strike the anchoring members or the clips. The member 31 is swung by exerting pressure on the upper end of an arm 6, the lower end of which is fixed to the member 31. The brackets 29 each have an upwardly extending spigot, of which only one (33) can be seen in FIG. 2, and these engage in respective ones of the cross members 8. When the arms 18 and 22 are to be moved from the position shown in FIG. 1, for driving clips on the inside of the rail, to the position shown in FIG. 2, for driving clips on the outside of the rail, the cross members 8 are lifted from these spigots, the carriage is held by handles 7 and turned through 180° about a vertical axis and then the cross members 8 are lowered again onto the spigots.

In FIGS. 3 and 4 the same sleepers 1, a rail 2, anchoring members 3 and clips 5 are shown and insulators 4 are present as in the first example but cannot be seen.

The clip-driving apparatus here includes a trolley comprising two carriages, only one of which is shown in the drawings, connected together by cross members 8, one carriage to run on one rail and the other carriage to run on the other rail. On each carriage there are two piston-and-cylinder devices 35, one on one side of the rail and on one side of the carriage and the other on the other side of the rail and of the carriage. There are, on the illustrated carriage only, two piston-and-cylinder devices 36 on opposite sides of the rail and of the carriage. Considering now only the illustrated carriage, the cylinders of the devices 35 and 36 are pivotally connected to the carriage at their left-hand ends (considering FIG. 3) by virtue of an axle 43 which passes through bores in solid parts of the cylinders, through two vertical plates 44 of the carriage and through two plates 42, there being a nut 45 screwed on to each end of the axle. The piston rod 34 of each device 35 is pivotally connected to the upper end of a respective one of two levers 37 and the piston rod 39 of each device 36 is pivotally connected to the upper end of a respective one of two levers 40. The fulcrum for each lever is provided by another axle 43 which passes through bores in the parts 37, 40, 44 and 42 and has a nut 45 screwed on to each end of it. On the lower end of each lever 40 there is fixed a plate 41 which is arranged to press against one side of a sleeper when the lever turns anticlockwise (considering FIG. 3) due to the piston rod 39 being retracted. On the lower end of each lever 37 there is fixed a replaceable pad 38 which is designed to push on the free end of the "fifth portion" 26 of a clip and/or on the "second portion" when the free end of the "first portion" has been inserted in the passage through an anchoring member 3 and when the piston rod 34 is extended further to the right so that the lever 40 turns clockwise (considering FIG. 3). The carriage which is not shown in the drawings is like the illustrated carriage but the parts 36, 39, 40 and 41 are missing. The four piston-and-cylinder devices 35 and the two piston-and-cylinder devices 36 are so controlled that, when the clips above one sleeper are to be driven into position and the trolley is moved by an operator into about the correct position above that sleeper, the devices 36 are at first operated so that the levers 40 are swung anticlockwise (considering FIG. 3) and the two plates 41 are pressed against the sleeper, one against one side and one against the other side, the trolley being thereby caused to move along the rails to exactly the correct position if it is not already there. When the pressure in the cylinder of one of the devices 36 increases to a particular value, say 50 p.s.i., the devices 35 are automatically actuated to swing the levers 37 simultaneously (clockwise, considering FIG. 3) so that the four pads 38 press against the clips and simultaneously drive them fully home the two levers 37 associated with each rail swinging in opposite directions and the two clips on opposite sides of each rail being driven in opposite directions parallel to the longitudinal axis of the rail, any tendency for the sleeper to move under the forces exerted by the pads 38 being resisted by the plates 41 being pressed against the sleepers. Then the devices 35 and 36 are actuated to swing the levers 37 and 40 so far in the opposite directions that the plates 41 and pads 38 cannot hit any part of the fastening assembly when the trolley is moved to the next sleeper.

Each carriage of the trolley includes a horizontal plate 46 which is integral with or connected to the two vertical plates 44 and through this pass screws 30 of two arrangements of parts 12 (wheel), 27 (bracket), 28 (pivotal connection of the bracket 27 to the vertical plates 44) 30 (screw) and 32 (tommy bar), for raising and lowering the levers 37 and 40 in the manner described in relation to the correspondingly numbered parts of FIG. 2.

There are also two handles 7 at each end of each carriage for use in lifting it when the trolley is dismantled. For ease of assembly and dismantling, the two carriages are connected together by cross members 8 each of which is fixed at its end to the carriages by screws 49 provided with handles 50 and engaging in captive nuts (not shown) beneath the plates 46. Each cross member is in two parts 8A and 8B end-to-end with a plate 51 welded to each and a sheet 52 of electrically insulating material between the two plates, which are joined together by screws 53 surrounded by electrically insulating sleeves. This arrangement ensures that the two rails are not electrically connected together by the clip-driving apparatus, which is important if the rails are used to carry signalling currents while the clips are being driven.

It is possible to use two entirely separate carriages, one on each rail, one as shown in FIGS. 3 and 4 and the other similar but with parts 36 and 39 to 41 omitted, or to use only one carriage, first on one rail and then on the other.

FIGS. 3 and 4 illustrate a feature of all the illustrated clips and of the clip according to U.S. Pat. No. 3,658,246 which is that the "fifth portion," in extending away from the "fourth portion," terminates before reaching an imaginary plane containing the furthest point on the "second portion" and perpendicular to the axis of the "first portion."

FIGS. 5 to 7 show an arrangement which can be used instead of or in addition to the parts 36 and 39 to 41 of FIGS. 3 and 4 in an apparatus which is otherwise as shown in those Figures (except for parts 54 and 55 mentioned below). Here a piston-and-cylinder device 56 is mounted above the horizontal plate 46 and can be operated to force apart the upper ends of the two levers 57, each of which swings between two plates 59 about a fulcrum 58, the lower ends of the levers 57 being forced closer together to grip the rail between them. This construction too lends itself to use of only one carriage or two independent carriages. A larger handle 54 is provided at each end of the carriage and the screw 30 has a lock nut 55.

If only one carriage is to be used, or two carriages not secured together are to be used, it is advantageous to have rollers supported by the plates 44 for engaging the sides of the head of the rail.

In the examples described above, the trolley or carriage is in each case moved manually along the rails. It could instead be driven along the rails by a hydraulic motor carried by the trolley or carriage or there could be a separate trolley with power-operated means for moving it stepwise along the track and a piston-and-cylinder arrangement for pulling the clip-driving trolley or carriage behind it in smaller steps, about equal to the pitch of the sleepers.

We claim:

1. Apparatus comprising wheels suitable for running along at least one of two rails of a railway track and for supporting the remainder of the apparatus, a spigot for entering one end of a passage afforded by one of two upward projections on opposite sides of a rail, a portion for engaging a clip a part of which is to be inserted into the other end of said passage and power-operated means for forcing said portion towards the spigot to drive said clip so that said part of it moves along said passage towards the spigot and the clip is driven into a position for holding down the rail.

2. Apparatus according to claim 1 in which the power-operated means are such as to drive the clip substantially parallel to the rails.

3. Apparatus according to claim 1 in which said spigot and said portion are supported on a member which is rotatable to a position where said spigot and said portion cannot engage the clip and the upward projection.

4. Apparatus according to claim 1 comprising adjusting means for adjusting vertically the positions of said spigot and said portion.

5. Apparatus according to claim 1 in which said portion is positioned to be further from the adjacent rail, when the apparatus is in use, than is said spigot, so that said portion can engage the free end of the clip which is beyond said passage, as seen from the rail.

6. Apparatus for driving rail clips into position to hold down each of two rails of a railway track, the apparatus comprising two carriages provided with wheels for running on respective ones of the rails and carrying in each case power-operated clip-driving means, and cross members securing the carriages together, the cross members including electrically insulating material so as to electrically insulate one carriage from the other.

7. Apparatus according to claim 6 comprising on each carriage two power-operated means for driving respective ones of two rail clips into positions for holding down opposite sides of the same rail.

8. Apparatus according to claim 6 comprising power-operated means for gripping the rail.

9. Apparatus according to claim 6 in which the power-operated means comprises at least one lever driven by a piston-and-cylinder device.

10. Apparatus for use in making in a railway track a rail-and-fastening assembly comprising a rail foundation having two upwardly extending projections, a rail laid on the rail foundation between these projections, each of which affords a passage substantially parallel to the rail, and two rail clips each of which comprises a length of resilient metal of rod form which is bent so as to have, progressing from one end of the length of metal to the other, a first portion which constitutes a substantially straight leg, then a second portion in the form of a reverse bend, then a third portion extending generally in the direction of said one end, then a fourth portion which extends from the third portion, generally to that side thereof upon which said leg is disposed, and constitutes a second reverse bend, and finally a fifth portion extending in the general direction towards the junction between the first and second portions, each clip being in a position in which the first portion is in one of the passages, the third portion bears on a flange of the rail and the fifth portion bears on a fixed, unyielding surface which, as seen from the rail, is beyond the first portion, said apparatus comprising a wheeled carriage constructed to run on one of the rails, first and second parts carried by the carriage and movable relatively to it whereby the said parts can be moved from first positions, in which they lie on the same side of said one rail but on opposite sides of said assembly, with the first part further from said one rail than is the second part, and movement of the carriage along the rail would make one of the first and second parts strike said assembly according to the direction of movement of the carriage, to second positions in which the carriage can be moved along the rail without either of said parts striking said assembly, a member of the carriage arranged for movement thereof in a predetermined direction to result in said parts coming closer together and means for causing fluid at pressure to cause said member to move in said predetermined direction when said first and second parts are in said first positions so that said first and second parts come closer together and this results in one of said clips being driven into its associated passage by said first part engaging the free end of the fifth portion of the clip.

11. A method of making in a railway track a rail-and-fastening assembly comprising a rail foundation having two upwardly extending projections, a rail laid on the rail foundation between these projections, each of which affords a passage substantially parallel to the rail, and two rail clips each of which comprises a length of resilient metal of rod form which is bent so as to have, progressing from one end of the length of metal to the other, a first portion which constitutes a substantially straight leg, then a second portion in the form of a reverse bend, then a third portion extending generally in the direction of said one end, then a fourth portion which extends from the third portion, generally to that side thereof upon which said leg is disposed, and constitutes a second reverse bend, and finally a fifth portion extending in the general direction towards the junction between the first and second portions but terminating before reaching an imaginary plane containing the furthest point on the second portion and perpendicular to the axis of the first portion, each clip being in a position in which the first portion is in one of the passages the third portion bears on a flange of the rail and the fifth portion bears on a fixed, unyielding surface which, as seen from the rail, is beyond the first portion, said method including applying fluid pressure to a piston-and-cylinder device one member of which is thereby moved and displaces a second member, a surface of which moves past said furthest point of one of the clips without engaging said second portion of the clip and engages the free end of said fifth portion of the clip whereby the clip is driven by the second member into said position.

12. Apparatus comprising wheels suitable for running along a rail of a railway track and for supporting the remainder of the apparatus, power-operated means for gripping the rail so that the apparatus can no longer move along the rail and, for association with said rail, two power-operated levers, free ends of which lie beside the rail one on each side thereof in use of the apparatus and can be simultaneously turned in opposite directions to drive rail clips simultaneously in opposite directions, parallel to the longitudinal axis of the rail, to drive the clips into their operative positions.

13. Apparatus comprising wheels suitable for running along both rails of a railway track and for supporting the remainder of the apparatus; power-operated means for gripping one of the rails so that the apparatus can no longer move along the rails; for association with one of the rails, two power-operated levers, free ends of which lie beside that rail, one on each side of that rail, in use of the apparatus and can be simultaneously turned in opposite directions to drive rail clips simultaneously in opposite directions parallel to the longitudinal axis of the rail, to drive the clips into their operative positions; for association with the other rail, two power-operated levers, free ends of which lie beside that rail, one on each side of that rail, in use of the apparatus and can be simultaneously turned in opposite directions to drive the rail clips simultaneously in opposite directions parallel to the longitudinal axis of the rail, to drive the clips into their operative positions.

14. Apparatus for driving rail clips into position to hold down rails of railway tracks, the apparatus comprising two carriages provided with wheels for running on respective ones of the two rails of a railway track, power-operated clip-driving means carried by the carriages and cross-members securing the carriages together, the cross-members including electrically insulating material so as to electrically insulate one carriage from the other.

* * * * *